US011517085B1

(12) United States Patent
Rivers

(10) Patent No.: US 11,517,085 B1
(45) Date of Patent: Dec. 6, 2022

(54) PERSONAL NOISEMAKER FAN DEVICES

(71) Applicant: Dannie Rivers, Deerfield Beach, FL (US)

(72) Inventor: Dannie Rivers, Deerfield Beach, FL (US)

( * ) Notice: Subject to any disclaimer, the term of this patent is extended or adjusted under 35 U.S.C. 154(b) by 0 days.

(21) Appl. No.: 17/826,397

(22) Filed: May 27, 2022

(51) Int. Cl.

| | |
|---|---|
| ***A47B 27/00*** | (2006.01) |
| ***F04D 25/08*** | (2006.01) |
| ***G10K 3/00*** | (2006.01) |
| ***A63H 5/00*** | (2006.01) |
| ***A45B 27/00*** | (2006.01) |

(52) U.S. Cl.
CPC ..... *A45B 27/00* (2013.01); *A63H 5/00* (2013.01); *F04D 25/084* (2013.01); *F04D 25/086* (2013.01); *G10K 3/00* (2013.01); *A45B 2200/1036* (2013.01)

(58) Field of Classification Search
CPC ..... A45B 27/00; A45B 2200/1009; A45B 2200/1036; A63H 5/00; G10K 3/00; F04D 25/084; F04D 25/086
USPC ..... 446/418, 419
See application file for complete search history.

(56) References Cited

U.S. PATENT DOCUMENTS 902,633 A * 11/1908 Wigand et al. ..... A45B 27/00 416/73
1,148,520 A * 8/1915 Mann ..... A45B 27/00 416/71
4,019,277 A * 4/1977 Kenkelen ..... A63H 5/00 84/402
4,075,922 A * 2/1978 Smith ..... G10D 13/24 446/422
4,179,973 A * 12/1979 White ..... G10D 13/06 446/419
4,810,228 A * 3/1989 Huggins ..... A63H 5/00 16/385
D312,529 S * 12/1990 Routt ..... D3/3
4,976,651 A * 12/1990 Frank ..... G10K 3/00 84/402
5,659,143 A * 8/1997 Isackson ..... G10D 13/24 446/419
5,984,761 A * 11/1999 Kalinowski ..... G10K 3/00 84/402
6,302,813 B1 * 10/2001 Sturgeon ..... A63B 59/59 446/419

(Continued)

FOREIGN PATENT DOCUMENTS

JP 2004242992 A * 9/2004
JP 3164806 U * 12/2010
JP 2012003291 A * 1/2012

OTHER PUBLICATIONS 4 page PDF of machine translation of JP-2004-242992. (Year: 2004).*

*Primary Examiner* — Robert Canfield
(74) *Attorney, Agent, or Firm* — The Law Firm of Andrea Hence Evans, LLC

(57) ABSTRACT

Personal fan devices that are configured to transition between an open configuration for use and a closed configuration for storage or transport. A fan device includes noisemaking structure(s), such as a rattle and/or a clapper, disposed with the fan device. As the fan device is moved, the handle generates noise as a result of the noisemaking structure(s). A plurality of fan devices may be used to generate high-decibel noises at an event, such as a sporting event or a performance.

18 Claims, 11 Drawing Sheets

(56) References Cited

U.S. PATENT DOCUMENTS

| | | | | |
|---|---|---|---|---|
| D469,601 | S * | 2/2003 | Scalise | D3/3 |
| D469,950 | S * | 2/2003 | Scalise | D3/3 |
| 6,736,695 | B1 | 5/2004 | Hoch | |
| 6,817,922 | B1 * | 11/2004 | Davies | A63H 5/00 446/81 |
| 7,530,876 | B1 | 5/2009 | Wimberly | |
| 7,942,108 | B2 * | 5/2011 | Sherrod | G09F 17/00 446/81 |
| 8,074,870 | B2 * | 12/2011 | Izyk | A01K 15/029 446/419 |
| 8,946,530 | B1 * | 2/2015 | Karapetyan | G10D 13/06 84/402 |
| 10,914,309 | B1 * | 2/2021 | Rivers | A45B 27/00 |
| 2002/0077022 | A1 | 6/2002 | Williams | |
| 2010/0227528 | A1 * | 9/2010 | Weiss | A63H 5/00 446/397 |
| 2012/0024503 | A1 | 2/2012 | SanFilippo | |
| 2016/0023122 | A1 | 1/2016 | Brown | |
| 2017/0130727 | A1 | 5/2017 | Deener, Jr. | |

* cited by examiner

PERSONAL NOISEMAKER FAN DEVICES

FIELD

The disclosure relates to personal fan devices that are configured to generate noises, as may occur during use by a spectator at a sporting event or performance. A hand-held novelty fan device transitions between an open configuration and a closed configuration and includes a rattle and/or a clapper with the handle of the fan device. As the device is moved, the handle generates noise as a result of the rattle and/or the clapper. A plurality of fan devices may be used to generate high-decibel noises at an event.

BACKGROUND

Many individuals attend events, such as sporting events and performances, wherein the ability to generate noise in support of or in opposition to a team, a player, or an aspect of the performance enhances the experience of the event or performance. These individuals may vocalize or whistle, clap their hands together, or stomp their feet. Vocalizing and whistling may be exhausting and may be difficult to sustain for extended periods of time, clapping hands may be similarly exhausting and may lead to sore hands, and stomping feet may produce limited noise on certain structures such as concrete stands and may be exhausting and lead to sore feet. All of these approaches for noise production may be difficult to sustain and may be unsatisfactory due to their not producing loud and persistent noises without exhausting or causing discomfort to the noise producer.

In addition, many events are held outdoors or in spaces where a handheld fan may be useful to have. For example, attendance of a baseball game may lend itself to use of personal fan devices for cooling attendants. In these and other situations, the use of a compact, portable, personal fan device would be beneficial for a variety of reasons, but at least some existing fan devices may not generate a desired type or amount of noise.

Accordingly, there is a need for noisemaking devices with fan form factors that are compact, portable, and personal, and which can reliably produce large amounts of desired noises for enhanced event attendance and other experiences. The present invention addresses this unmet need.

SUMMARY

In one aspect, the disclosure provides a fan device configured to transition from an open configuration to a closed configuration for storage or transport and from the closed configuration to the open configuration for use. The fan device comprises a cover that includes a first member hingedly attached to a handle and a second member hingedly attached to the handle, such that the first and second members move about one or more hinges relative to the handle. In the closed configuration, the fan device may resemble a bat, such as a baseball bat.

The cover encloses a fan in the closed configuration and exposes the fan in the open configuration. In various embodiments, the handle includes a hollow space therein that comprises a plurality of beads therein configured to produce noise during movement of the handle, and/or the handle includes a clapper attached thereto configured to produce noise during movement of the handle. The combination of the beads and the clapper may produce more noise compared to the beads alone or the clapper alone, and/or may produce a wider variety of noises compared to the beads alone or the clapper alone.

In embodiments, the fan comprises a plurality of blades configured to transition between the closed configuration and the open configuration by slide movements of blades over blades and pivot movements of blades about a pivot point. However, in alternate embodiments, the fan may comprise a single sheet that is foldable along a plurality of fold lines. Accordingly, any suitable fan configuration may be implemented according to a particular embodiment of the fan device.

In embodiments, the handle is rigid and effectively conducts mechanical and sound vibrations, such that movement of the handle shifts beads to contact internal surfaces that define the hollow space of the handle to produce noise. The resultant rattle may produce noises when the fan device is moved in any of a plurality of directions or movements.

In embodiments, the clapper comprises a first clap member and a second clap member, and movement of the handle claps the first clap member against the second clap member to produce noise. The resultant clapper may produce noises when the fan device is moved in a direction perpendicular to a plane of the clapper.

In embodiments, the fan device further comprises a spring that biases the first member and the second member of the cover. The spring may bias the first member and the second member toward the open configuration. In this manner, the user may be assisted with opening the device.

In embodiments, the fan device further comprises a hook and a clasp disposed on the cover, such that the hook and the clasp are configured to maintain the fan device in the closed configuration. In embodiments, the spring may bias the first member and the second member toward the open configuration and the hook and clasp hold the cover in the closed configuration against the bias of the spring.

The invention generally relates to novelty fan devices which may be manufactured with appropriate materials and processes, and which may be scaled as needed in response to demand.

Other objects, features, and advantages of the invention will become apparent from the following detailed description taken in conjunction with the accompanying drawings.

BRIEF DESCRIPTION OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1A:
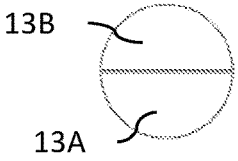
FIG. 1A shows a top view of an exemplary fan device of the present invention, in a closed configuration.
Figure 1B:
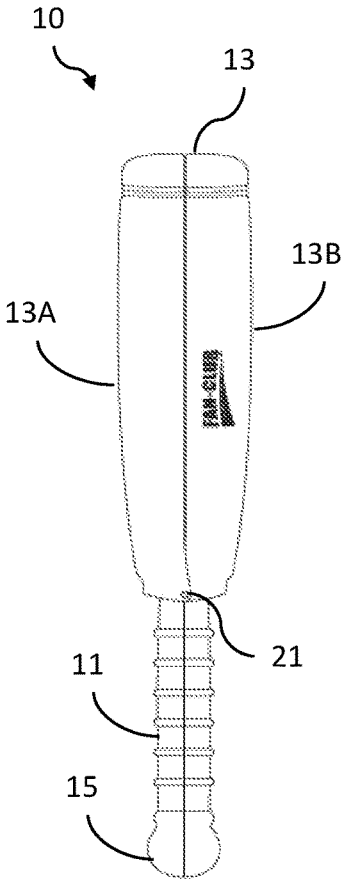
FIG. 1B shows a front view of the exemplary fan device.
Figure 1C:
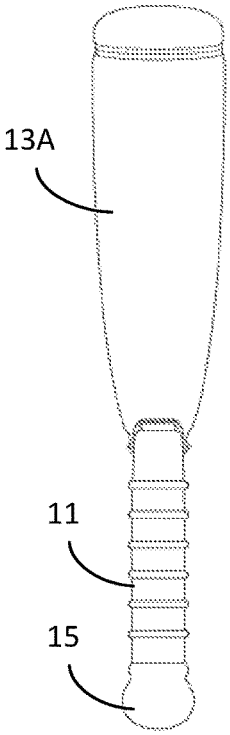
FIG. 1C shows a left view of the exemplary fan device.
Figure 1D:
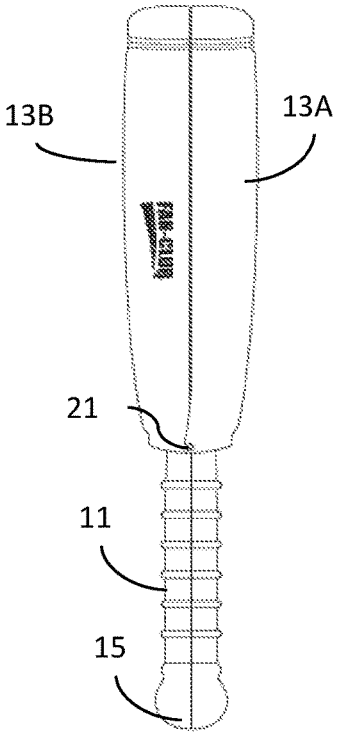
FIG. 1D shows a rear view of the exemplary fan device.

Reference is made herein to the attached drawings. Like reference numerals may be used in the drawings to indicate like or similar elements of the description. The figures are intended for representative purposes and should not be considered limiting.

The present disclosure can be understood more readily by reference to the following detailed description of the present disclosure and the examples included therein.

Before the present articles, systems, devices, and/or methods are disclosed and described, it is to be understood that they are not limited to specific implementations unless otherwise specified, or to particular approaches unless otherwise specified, as such can, of course, vary. It is also to be understood that the terminology used herein is for the purpose of describing aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

Definitions

It is to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this present disclosure belongs. In this specification and in the claims which follow, reference will be made to a number of terms which shall be defined herein.

As used in the specification and the appended claims, the singular forms "a," "an," and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the present disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the present disclosure. Thus, if there are a variety of additional steps that can be performed it is understood that each of these additional steps can be performed with any specific aspect or combination of aspects of the methods of the present disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Fan Devices

The present disclosure provides personal, handheld, novelty fan devices that are configured to generate noises during use, as may occur during use by a spectator at a sporting event or performance, such as a baseball game. A hand-held novelty fan device transitions between an open configuration and a closed configuration and includes a rattle and/or a clapper with the handle of the fan device. As the device is moved, the handle generates noise as a result of the rattle and/or the clapper. The fan device is useful for an individual to easily generate noises at an event, without necessarily needing to use additional or separate items to produce the noises. In this manner, the fan devices are more convenient and effective for noise production and also may be used as a fan to cool individuals.

Referring now to FIGS. 1A-1I, there are shown several views of an exemplary fan device of the present invention, in a closed configuration and with or without a clapper attached thereto. In general, the disclosure provides a fan device 10 configured to transition from an open configuration (see FIG. 1J) to a closed configuration (see FIGS. 1A-1I) for storage or transport and from the closed configuration to the open configuration for use. The fan device 10 comprises a cover 13 that includes a first member 13A hingedly attached to a handle 11 and a second member 13B hingedly attached to the handle 11, such that the first and second members 13A, 13B move about hinge 21 relative to the handle 11. In the closed configuration, the fan device 10 may resemble a bat, such as a baseball bat, as shown, and the cover may include identifying indicia thereon, e.g., "Fan-Club" as shown, or alternately, may include a name of a sports team, a name of a performer, a name of a vendor, a name of a fan or individual, a name of a company or product or service, etc.

In various embodiments, the cover 13 encloses a fan in the closed configuration and exposes the fan in the open configuration. In embodiments, the handle 11 includes a hollow space therein that comprises a plurality of beads 20 therein configured to produce noise during movement of the handle 11 (see FIG. 4). The handle 11 may include a clapper 19 attached to a bottom 15 of the handle 11 that is configured to produce noise during movement of the handle 11 (see FIGS. 1F-1I). A combination of the beads 20 and the clapper 19 may produce more noise compared to the beads 20 alone or the clapper 19 alone, and/or may produce a wider variety of noises compared to the beads 20 alone or the clapper 19 alone.

A clapper 19 comprises a first clap member (see 19A of FIGS. 3A-3F) and a second clap member (see 19B of FIGS. 3A-3F), and movement of the handle 11, particularly, movement perpendicular to a plane of the clapper 19, helps clap the first clap member 19A against the second clap member 19B to produce clapping noises. In this manner, the user can generate clapping noises without necessarily clapping their hands together.

Figure 1E:
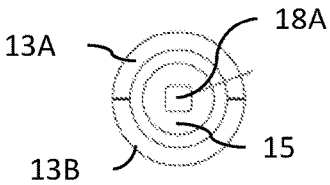
FIG. 1E shows a bottom view of the exemplary fan device.
Figure 1F:
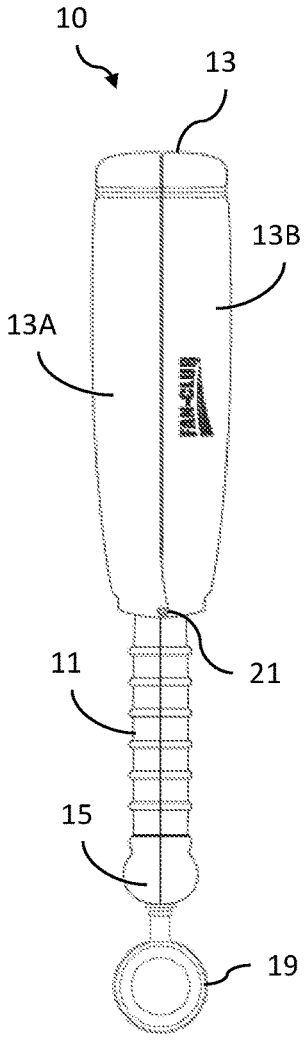
FIG. 1F shows a front view of the exemplary fan device, with a clapper attached thereto.
Figure 1G:
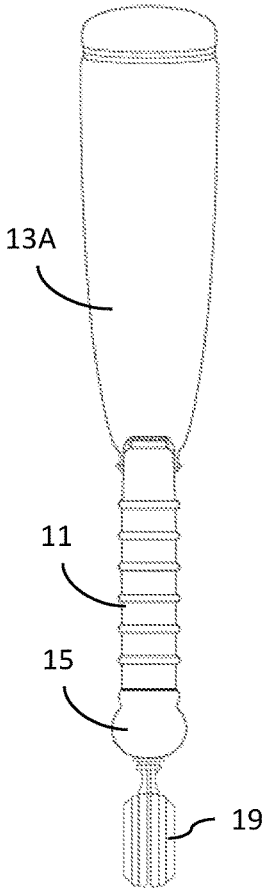
FIG. 1G shows a left view of the exemplary fan device, with the clapper attached thereto.
Figure 1H:
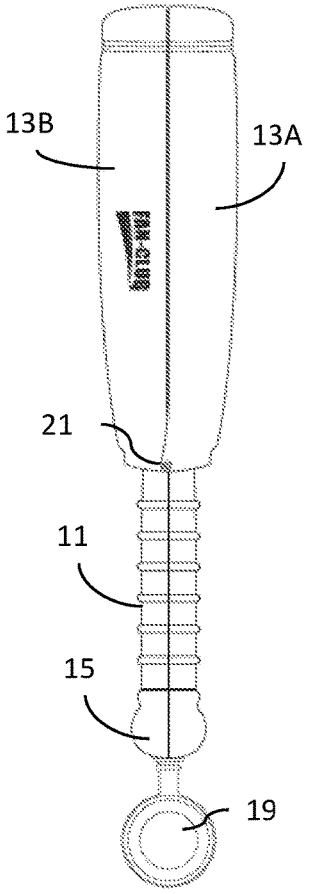
FIG. 1H shows a rear view of the exemplary fan device, with the clapper attached thereto.
Figure 1I:
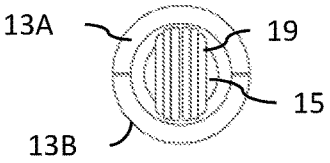
FIG. 1I shows a bottom view of the exemplary fan device, with the clapper attached thereto.
Figure 1J:
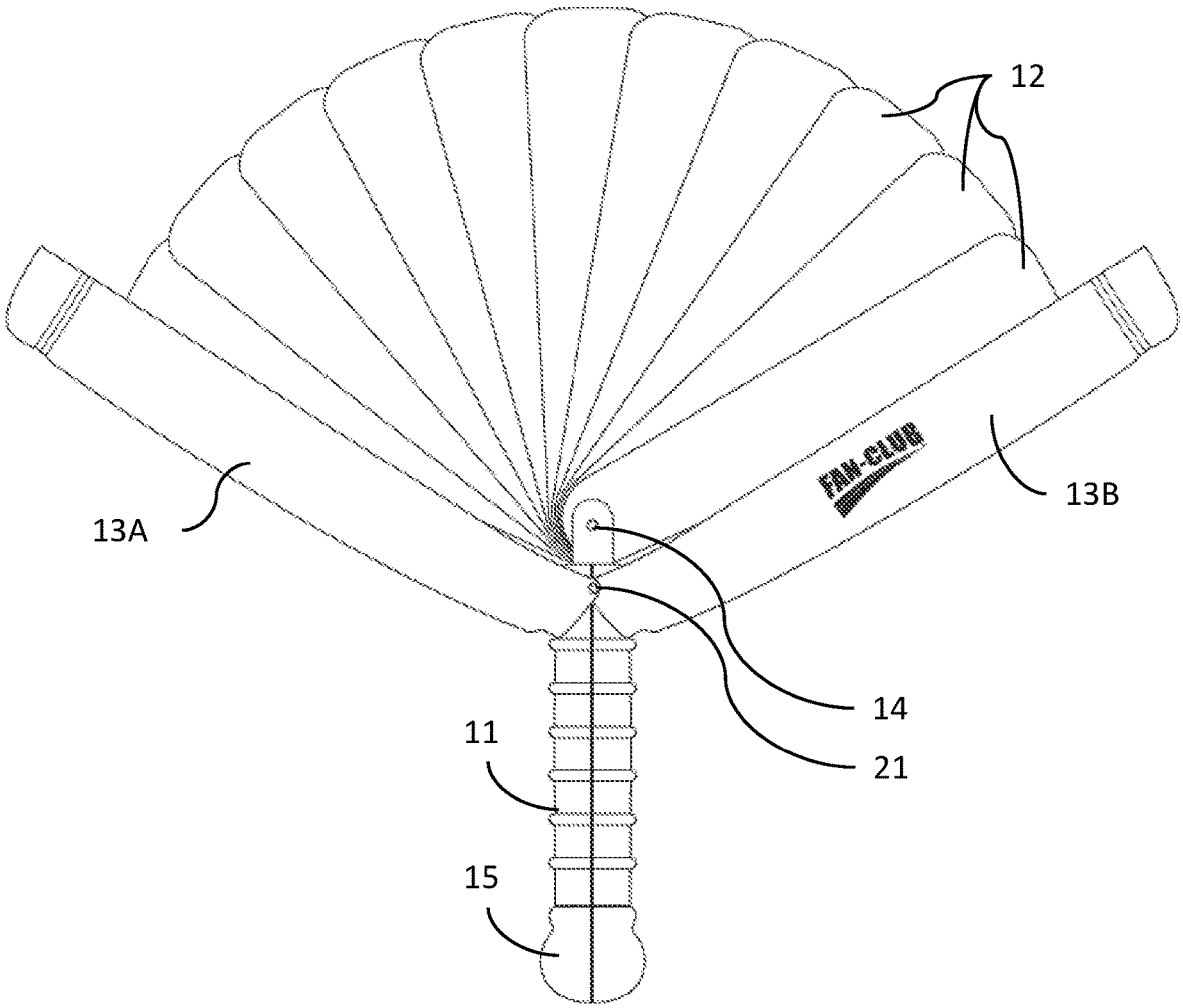
FIG. 1J shows a front view of the exemplary fan device, in an open configuration.

Referring now to FIG. 1J, there is shown a front view of the exemplary fan device, in an open configuration. In embodiments, the fan comprises a plurality of blades 12 configured to transition between the closed configuration and the open configuration by slide movements of blades 12 over blades 12 and pivot movements of blades 12 about a pivot point 14. In embodiments, the fan and/or the fan blades are comprised of a woven material, a plastic, a paper, or any combination thereof.

Figure 2A:
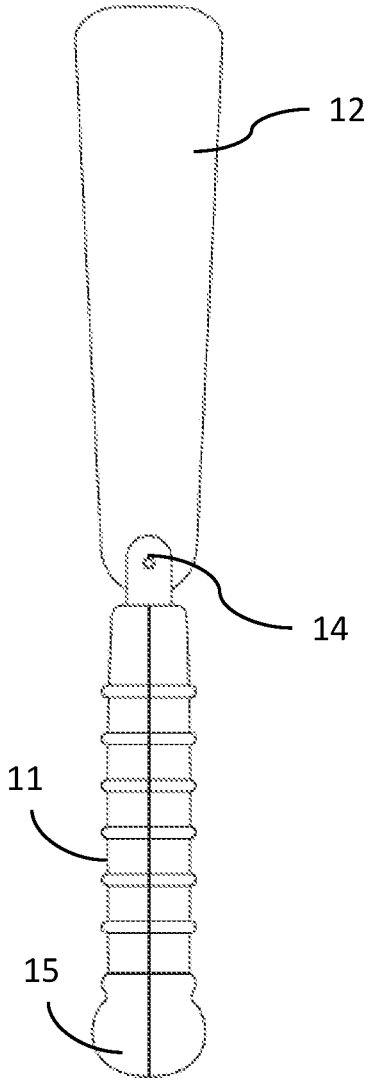
FIG. 2A shows a front view of an alternate exemplary fan device, in a closed configuration.
Figure 2B:
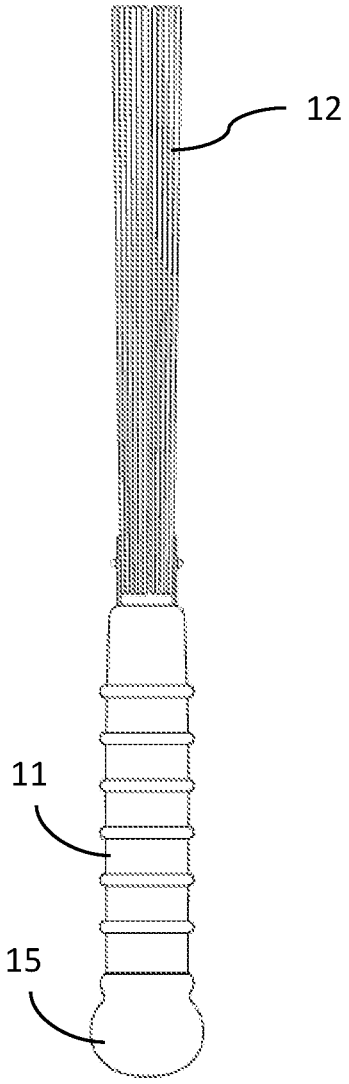
FIG. 2B shows a side view of the alternate exemplary fan device, in the closed configuration.
Figure 2C:
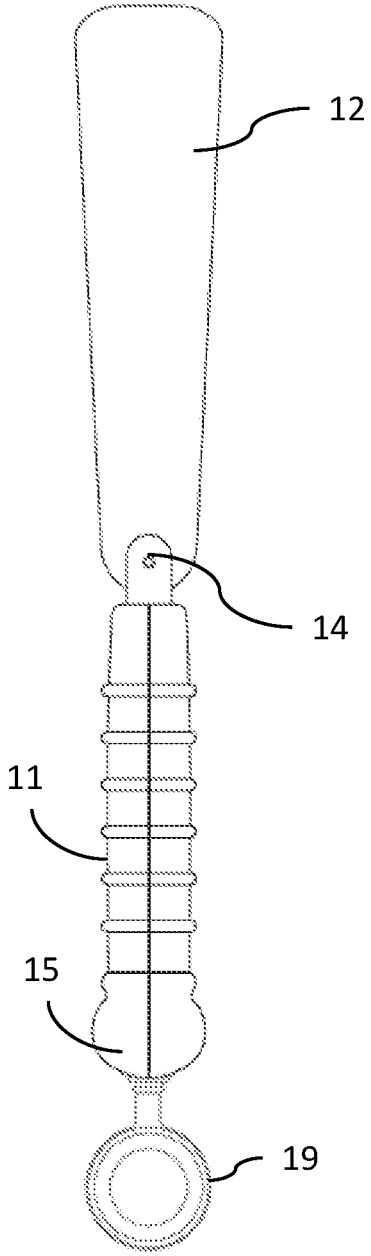
FIG. 2C shows a front view of the alternate exemplary fan device, in the closed configuration, with a clapper attached thereto.
Figure 2D:
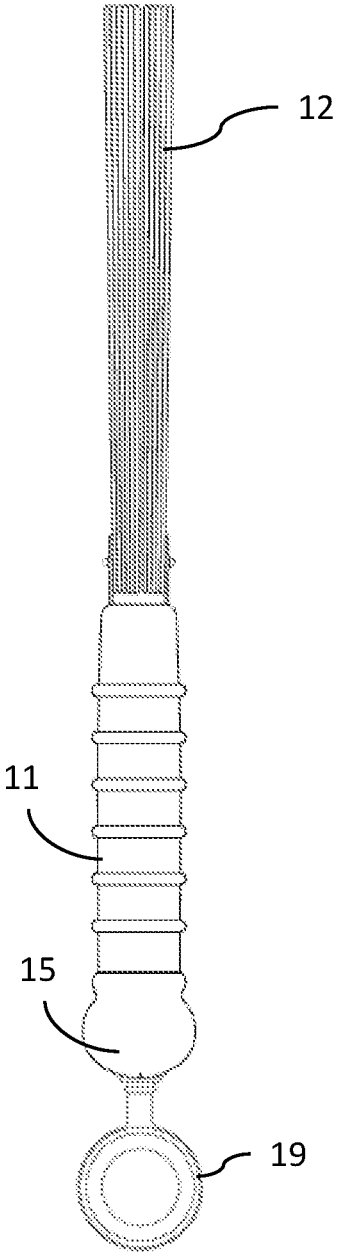
FIG. 2D shows a side view of the alternate exemplary fan device, in the closed configuration, with the clapper attached thereto.
Figure 3A:
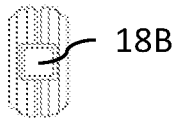
FIG. 3A shows a top view of an exemplary clapper, according to the present invention.
Figure 3B:
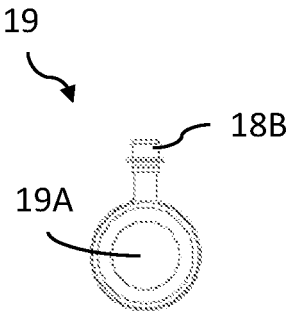
FIG. 3B shows a front view of the exemplary clapper.
Figure 3C:
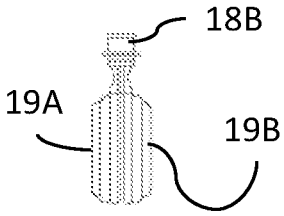
FIG. 3C shows a left view of the exemplary clapper.
Figure 3D:
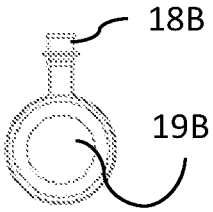
FIG. 3D shows a rear view of the exemplary clapper.
Figure 3E:
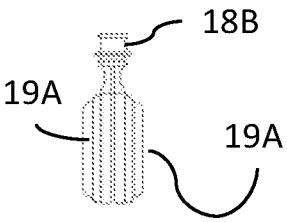
FIG. 3E shows a right view of the exemplary clapper.
Figure 3F:
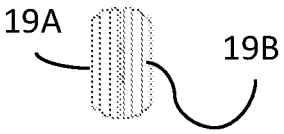
FIG. 3F shows a bottom view of the exemplary clapper.

Referring now to FIGS. 2A and 2B, there are shown views of an alternate exemplary fan device, in a closed configuration. In embodiments, the cover may be optional or absent from a particular fan device or configuration. In such instances, the fan blades 12 may be visible or uncovered by a cover, regardless of whether the fan device is in an open configuration (e.g., fan blades expanded for use) or a closed configuration (e.g., fan blades contracted, as shown). A clapper 19 may be attached to the bottom 15 of the handle 11, as shown at FIGS. 2C and 2D, and used to generate clapping noises.

Referring now to FIGS. 3A-3F, there are shown several views of an exemplary clapper, according to the present invention. A clapper 19 includes a first clapper member flexibly affixed to attachment base 18B, and a second clapper member flexibly attached to attachment base 18B. Attachment base 18B is attachable to corresponding attachment site 18A of the bottom 15 of the handle 11 of the fan device 10, as shown at FIG. 1E. In the shown embodiment the attachment site 18A is a female recipient (see 18A of FIG. 4) and the attachment base 18B is a male member, which is insertable into the female recipient and securable therein by way of ribs of male member which are flexibly securable within the cavity of the female recipient. However, alternate connection means are envisioned without departing from the scope of the invention.

Figure 4:
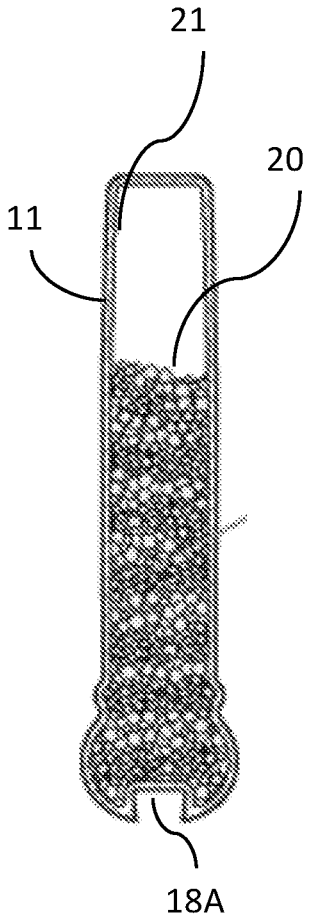
FIG. 4 shows a cross-sectional view of an exemplary handle with beads therein, according to the present invention.

Referring now to FIG. 4, there is shown a cross-sectional view of an exemplary handle with beads therein, according to the present invention. In embodiments, the handle 11 is rigid and effectively conducts mechanical and sound vibrations, such that movement of the handle 11 shifts beads 20 to contact internal surfaces 21 that define the hollow space of the handle to produce noise. The handle may be comprised of any suitable material, including but not limited to a metal, a plastic, a carbon fiber, a wood, or any combination thereof.

Figure 5A:
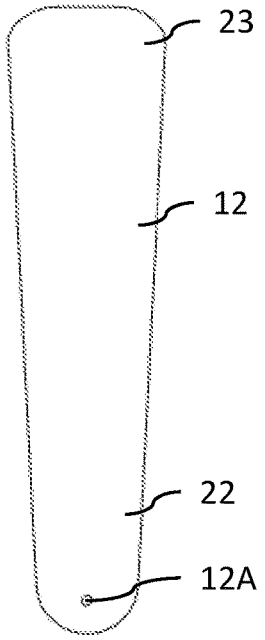
FIG. 5A shows a front view of an exemplary fan blade, according to the present invention.
Figure 5B:
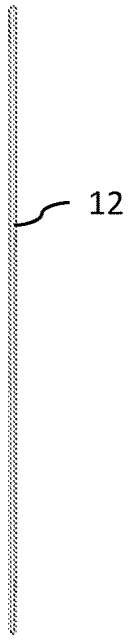
FIG. 5B shows a side view of the exemplary fan blade.
Figure 5C:
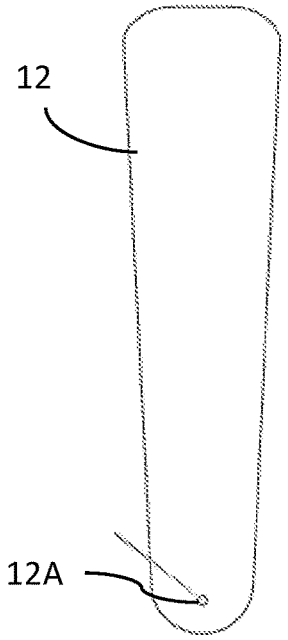
FIG. 5C shows a rear view of the exemplary fan blade.

Referring now to FIGS. 5A-5C, there are shown several views of an exemplary fan blade, according to the present invention. A fan blade 12 includes a narrow proximal portion 22 and a wide distal portion 23. The narrow proximal portion 22 includes an aperture 12A therethrough which enables the fan blade 12 to be pivotally affixed to a pivot point (see fan blade pivot point 14 of FIGS. 1J, 2A, and 2C). Movement of the fan blades 12 about the pivot point 14 enables opening and closing of the fan as it transitions between the open and closed configurations.

Figure 6:
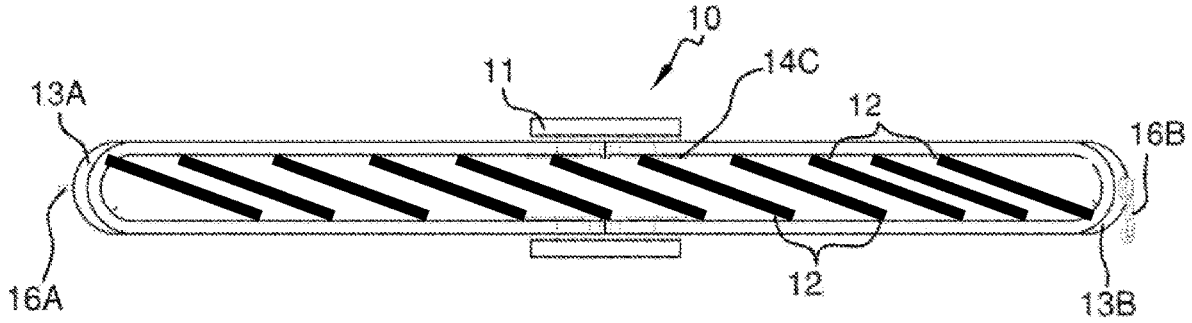
FIG. 6 shows a top view of an exemplary fan device of the present invention, in an open configuration.

Referring now to FIG. 6, there is shown a top view of an exemplary fan device of the present invention, in an open configuration. In embodiments, the fan device 10 further comprises a spring 14C that biases the first member 13A and the second member 13B of the cover from the closed configuration toward the open configuration. In embodiments, the fan device further comprises a hook 16A and a clasp 16B disposed on the cover (13A, 13B) and configured to maintain the fan device in the closed configuration. The fan blades 12 may have some overlap when in the open configuration, as shown.

Figure 7A:
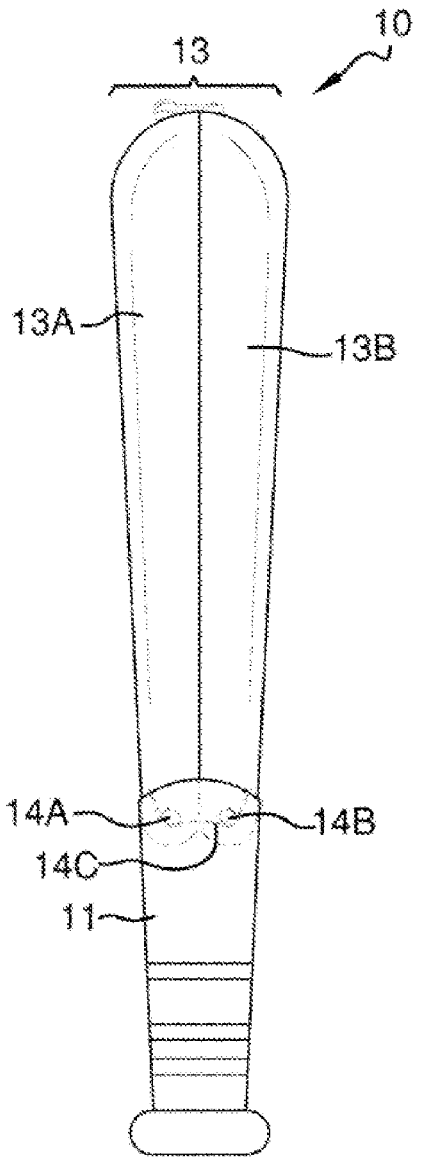
FIG. 7A shows a front view of an alternate exemplary fan device, in a closed configuration.
Figure 7B:
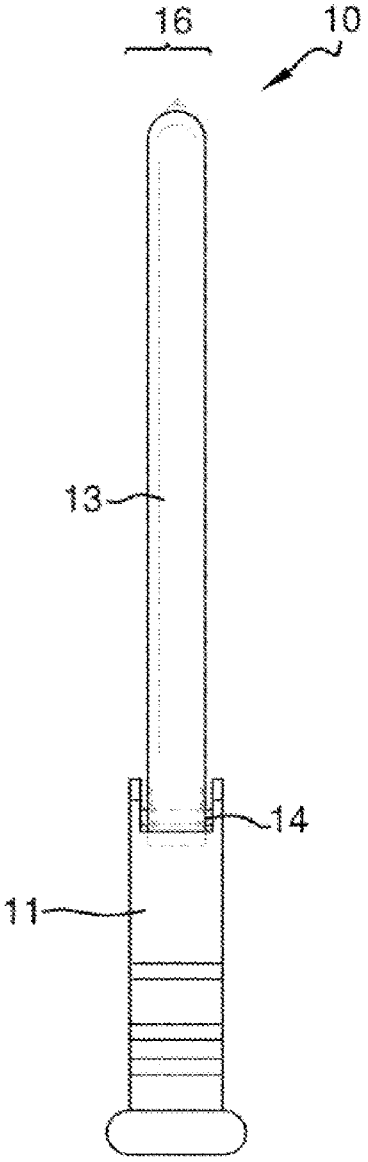
FIG. 7B shows a left view of the alternate fan device, in the closed configuration.

Referring now to FIGS. 7A and 7B, there are shown views of an alternate exemplary fan device, in a closed configuration. In embodiments, the fan device 10 includes two fan blade pivot points (14A, 14B) and may further comprise a spring 14C that biases the first member 13A and the second member 13B of the cover 13 from the closed configuration toward the open configuration. However, the expandable fan may involve hinges 14A and 14B that are not spring-loaded, such that the user may need to grasp both the handle 11, the left piece 13A, and the right piece 13B about the hinges in order to hold the fan open. In the shown embodiment the fan device 10 further comprises connection structures 16 (e.g., a hook 16A and a clasp 16B; see FIG. 6) that is disposed on the cover 13 and configured to maintain the fan device 10 in the closed configuration. In this manner, when the user grasps the handle 11 of the device 10, the device may be moved to generate noise without inadvertently opening the cover 13 of the fan device.

Figure 8:
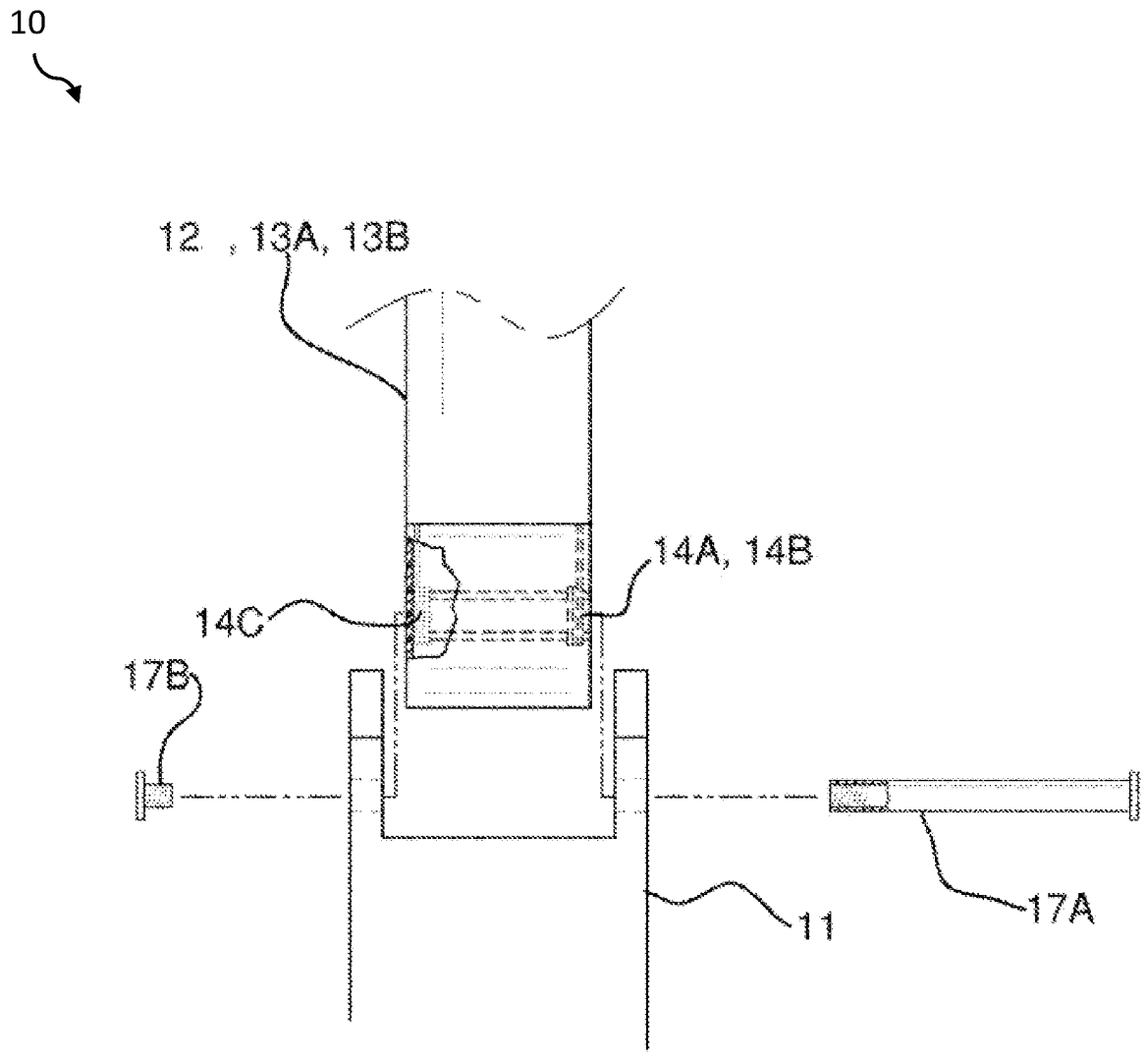
FIG. 8 shows a cutaway view of an exemplary fan device, wherein the fan can be removed from the handle by removal of a threaded pin and screw that otherwise secures the fan to the handle.

Referring now to FIG. 8, there is shown a cutaway view of an exemplary fan device 10, wherein the fan blades 12 and/or the cover members (13A, 13B) can be removed from the handle 11 by removal of a threaded pin 17B and screw 17A that otherwise secures the fan blades 12 and/or the cover members (13A, 13B) to the handle 11. The fan device 10 may further comprise a spring 14C that biases the first member 13A and the second member 13B of the cover, from the closed configuration toward the open configuration. In this manner, use of the fan device 10 may be assisted by the bias of the spring 14C.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior present disclosure. Further, the dates of publication provided herein can be different from the actual publication dates, which can require independent confirmation.

The patentable scope of the present disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Insofar as the description above and the accompanying drawing disclose any additional subject matter that is not within the scope of the claims below, the disclosures are not dedicated to the public and the right to file one or more applications to claims such additional disclosures is reserved.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

The following is claimed:

1. A fan device configured to transition between an open configuration and a closed configuration, the fan device comprising:

a cover comprising a first member hingedly attached to a handle and a second member hingedly attached to the handle, wherein the cover encloses a fan in the closed configuration and exposes the fan in the open configuration;

wherein:

the handle comprises a hollow space therein that comprises a plurality of beads therein configured to produce noise during movement of the handle; and the handle comprises a clapper attached thereto configured to produce noise during movement of the handle.

2. The fan device of claim 1, wherein the fan comprises a plurality of blades configured to transition between the closed configuration and the open configuration by slide movements of blades over blades and pivot movements of blades about a pivot point.

3. The fan device of claim 1, wherein the handle is rigid and effectively conducts sound vibrations, wherein movement of the handle shifts beads to contact internal surfaces that define the hollow space of the handle to produce noise.

4. The fan device of claim 1, wherein the clapper comprises a first clap member and a second clap member, wherein movement of the handle claps the first clap member against the second clap member to produce noise.

5. The fan device of claim 1, wherein the cover resembles a baseball bat in the closed configuration.

6. The fan device of claim 1, further comprising a spring that biases the first member and the second member of the cover.

7. The fan device of claim 1, further comprising a hook and a clasp disposed on the cover and configured to maintain the fan device in the closed configuration.

8. The fan device of claim 1, wherein the handle comprises: a metal, a plastic, a carbon fiber, or a wood.

9. The fan device of claim 1, wherein the fan comprises a woven material, a plastic, or a paper.

10. A fan device configured to transition between an open configuration and a closed configuration, the fan device comprising:

a cover comprising a first member hingedly attached to a handle and a second member hingedly attached to the handle, wherein the cover encloses a fan in the closed configuration and exposes the fan in the open configuration;

wherein a spring biases the first member and the second member of the cover;

wherein:

the handle is rigid and effectively conducts sound vibrations and comprises a hollow space therein that comprises a plurality of beads therein, wherein movement of the handle shifts beads to contact internal surfaces that define the hollow space of the handle to produce noise; and/or the handle comprises a clapper attached thereto configured to produce noise during movement of the handle, wherein the clapper comprises a first clap member and a second clap member, wherein movement of the handle claps the first clap member against the second clap member to produce noise;

wherein the handle comprises a hook and a clasp disposed on the cover and configured to maintain the fan device in the closed configuration.

11. The fan device of claim 10, wherein the fan comprises a plurality of blades configured to transition between the closed configuration and the open configuration by slide movements of blades over blades and pivot movements of blades about a pivot point.

12. The fan device of claim 10, wherein the cover resembles a baseball bat in the closed configuration.

13. The fan device of claim 10, wherein the handle comprises: a metal, a plastic, a carbon fiber, or a wood.

14. The fan device of claim 10, wherein the fan comprises a woven material, a plastic, or a paper.

15. A fan device configured to transition between an open configuration and a closed configuration, the fan device comprising:

a cover comprising a first member hingedly attached to a handle and a second member hingedly attached to the handle, wherein the cover encloses a fan in the closed configuration and exposes the fan in the open configuration, wherein the fan comprises a plurality of blades configured to transition between the closed configuration and the open configuration by slide movements of blades over blades and pivot movements of blades about a pivot point;

wherein:

the handle is rigid and effectively conducts sound vibrations and comprises a hollow space therein that comprises a plurality of beads therein, wherein movement of the handle shifts beads to contact internal surfaces that define the hollow space of the handle to produce noise; and the handle comprises a clapper attached thereto configured to produce noise during movement of the handle, wherein the clapper comprises a first clap member and a second clap member, wherein movement of the handle claps the first clap member against the second clap member to produce noise.

16. The fan device of claim 15, wherein the cover resembles a baseball bat in the closed configuration.

17. The fan device of claim 15, further comprising a spring that biases the first member and the second member of the cover.

18. The fan device of claim 15, further comprising a hook and a clasp disposed on the cover and configured to maintain the fan device in the closed configuration.

* * * * *